US008328613B2

(12) United States Patent
Filo et al.

(10) Patent No.: US 8,328,613 B2
(45) Date of Patent: Dec. 11, 2012

(54) GAME TOWER

(75) Inventors: Andrew S Filo, Cupertino, CA (US); David G Capper, Novato, CA (US); Charles Albert, Redwood City, CA (US)

(73) Assignee: Hasbro, Inc., Pawtucket, RI (US)

( * ) Notice: Subject to any disclaimer, the term of this patent is extended or adjusted under 35 U.S.C. 154(b) by 107 days.

(21) Appl. No.: 12/946,509

(22) Filed: Nov. 15, 2010

(65) Prior Publication Data

US 2011/0115157 A1 May 19, 2011

Related U.S. Application Data

(60) Provisional application No. 61/261,855, filed on Nov. 17, 2009.

(51) Int. Cl.
*A63F 9/24* (2006.01)

(52) U.S. Cl. ..... 463/10; 463/29; 273/237; 348/143

(58) Field of Classification Search ..... 463/47; 273/237

See application file for complete search history.

(56) References Cited

U.S. PATENT DOCUMENTS

| | | | | |
|---|---|---|---|---|
| 4,799,678 | A | 1/1989 | Terzian et al. | |
| 4,843,568 | A | 6/1989 | Krueger et al. | |
| 5,288,078 | A | 2/1994 | Capper et al. | |
| 5,454,043 | A | 9/1995 | Freeman | |
| 5,521,616 | A | 5/1996 | Capper et al. | |
| 5,594,469 | A | 1/1997 | Freeman et al. | |
| 6,002,808 | A | 12/1999 | Freeman | |
| 6,690,156 | B1 | 2/2004 | Weiner et al. | |
| 6,766,036 | B1 | 7/2004 | Pryor | |
| 7,394,459 | B2 | 7/2008 | Bathiche et al. | |
| 7,401,783 | B2 | 7/2008 | Pryor | |
| 7,404,765 | B2 | 7/2008 | Soltys et al. | |
| 2002/0006820 | A1 | 1/2002 | Romero | |
| 2003/0062675 | A1 | 4/2003 | Noro et al. | |
| 2003/0236113 | A1 | 12/2003 | Webb | |
| 2005/0024493 | A1* | 2/2005 | Nam | 348/143 |
| 2006/0118634 | A1 | 6/2006 | Blythe et al. | |
| 2008/0132332 | A1* | 6/2008 | Pryor | 463/31 |
| 2009/0118001 | A1* | 5/2009 | Kelly et al. | 463/29 |

FOREIGN PATENT DOCUMENTS

CN 1448884 A 10/2003

(Continued)

OTHER PUBLICATIONS

U-Force TM product, Broderbund Software, Inc. Copyright 1989.

*Primary Examiner* — David L Lewis
*Assistant Examiner* — Werner Garner
(74) *Attorney, Agent, or Firm* — Perry Hoffman

(57) ABSTRACT

A light source, a convex mirror and an optical sensor are disposed within a housing which is transparent to the range of wavelengths from the light source and of a low distortion scratch-resistant material. A game board is used with retro-reflective elements, such as moveable playing markers or game tokens, cards or regions affixed to and integrated into the game board. A data store stores the locations of the reflective elements and other game-related data, such as data needed to measure a player's score or position in a game or data to provide guided play. The convex mirror is disposed inside the housing such that light reflects from the light source, off the convex mirror, through the housing, and onto the game board.

20 Claims, 15 Drawing Sheets

FOREIGN PATENT DOCUMENTS

| | | | |
|---|---|---|---|
| GB | 2429929 | A | 3/2007 |
| JP | 09056871 | A | 3/1997 |
| JP | 09108403 | A | 4/1997 |
| JP | 09285593 | A | 11/1997 |
| JP | 2004160170 | A | 6/2004 |
| JP | 2008295651 | A | 12/2008 |
| SE | 528882 | C2 | 3/2007 |

* cited by examiner

138
| | | |
|---|---|---|
| 1 | 2 | 3 |
| 4 | 5 | 6 |
| 7 | 8 | 9 |
| | 0 | |
FIG. 10A
140
| | | | |
|---|---|---|---|
| | 7 | 4 | 1 |
| 0 | 8 | 5 | 2 |
| | 9 | 6 | 3 |
FIG. 10B
142
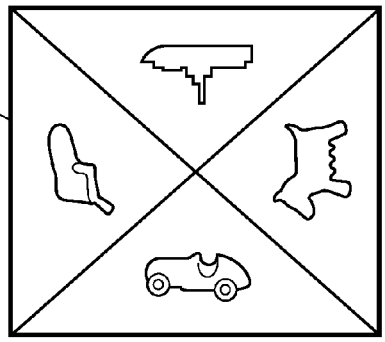
FIG. 10C
144
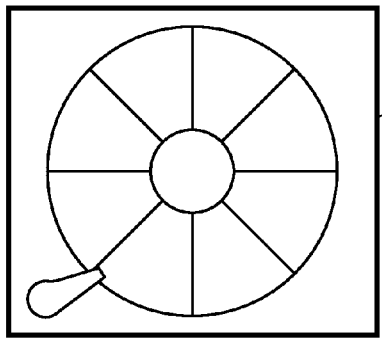
FIG. 10D

GAME TOWER

CROSS-REFERENCE TO RELATED APPLICATION

This application claims priority pursuant to 35 U.S.C. 119 (e) to U.S. Provisional Application No. 61/261,855, filed on Nov. 17, 2009 which is incorporated herein by reference in its entirety.

FIELD OF THE INVENTION

The present invention relates generally to a game assembly, and more particularly to a board game that utilizes a camera and a computer for interactive and guided game play.

BACKGROUND OF THE INVENTION

Computers have enhanced the way traditional board games can be played. For example, games such as Monopoly™, Battleship™ and Scrabble™, as well as almost any other board game, have been adapted so that a single user can download the game to a personal computer and play the game against virtual opponents. Such downloadable games offer one the convenience of being able to enjoy a board game any time recreation is desired without having to depend on the presence of others. Computerized board games also allow one to enhance one's skills at playing the board game with minimal resources. Additionally, such board games may also be played online, where one's opponents are either virtual players or live players at remote locations. Playing online against remote opponents offers all the benefits of playing a downloadable version of the game against virtual opponents but removes the potential predictability of algorithmic play inherent in the downloadable games. However, despite the benefits that this type of computerization of board games offers, those desiring human interaction are not benefited by using a computer to enhance a board game by playing against virtual or online opponents.

Computers have also been used in conjunction with one or more cameras to enhance board game play. For example, United States Patent Application number US2003/0236113, by Webb, for "Game Playing Apparatus" discloses a game playing structure onto which cards may be dealt by a dealer standing at a table. An imaging device is used to create an image signal representative of dealt cards, whether the cards are dealt face up or face down, and a player terminal in communication with the imaging device allows a remote player to play using the terminal. Thus, a player may play a "live" card game at a remote location with players standing at the card table or with players at other remote locations, including placing bets and sending other playing instructions through the terminal. The imaging may be performed by visual means or by non-visual means, such as a bar code or a magnetic sensor. The described apparatus may also keep statistics, such as might be used to facilitate wagering. This invention disclosed by Webb requires recognition of information on the card or playing marker. U.S. Pat. No. 7,404,765, issued to Soltys, et al., for "Determining Gaming Information" discloses a method and an apparatus for determining wagers by using a camera and image recognition to recognize the denominations of betting chips as marked by color transitions on the chips. This invention, disclosed by Soltys, et al. requires recognition of the specific markings on a playing marker.

United States Patent Application number US2003/0062675, by Noro, et al., for "Image Experiencing System and Information Processing Method" discloses an apparatus and method for using a camera to determine position and direction information representing the view of a player with respect to a game board and to generate computer graphics based on the items on the game board for display on a head-mounted display superimposed on the game board. This invention to Noro, et al., requires playing piece recognition.

U.S. Pat. No. 6,690,156, issued to Weiner, et al., for "Physical Object Location Apparatus and Method and a Graphic Display Device Using the Same" discloses a method and a device for detecting and recognizing physical objects, such as playing pieces on a game board or graphic display, wherein the playing pieces each have a detectable identifier in the form of electronic circuitry. The inventors therein recognize that this invention requires each playing piece to have an independent power source and that dirt may obscure the sensors on the individual playing pieces.

United States Patent Application number US2002/0006820, by Romero, for "Assembly for Playing a Variation of the Game of Baccarat" discloses a baccarat table enhanced by one or more camera assemblies, each coupled to an optical scanning device, that electronically determine the total number count of at least the first two cards of each of the player's hands. Similarly, United Kingdom Patent Application number GB 2,429,929, by Elliot, for "Card Game Playing Apparatus" discloses an invention for playing cards using a live dealer and some remote players communicating via a network such as the internet. Each card carries a machine readable code and each station where cards are dealt has a code reader, and cameras are used to transmit information describing the card as well as images of the faces of other players. These inventions require identification of the playing cards and the markings thereon.

All the inventions described thus far require recognition of playing markers or cards or some characteristic unique to an individual playing marker or card. Similarly, U.S. Pat. No. 7,401,783, issued to Pryor, for "Camera Based Man Machine Interfaces" discloses "methods and apparatus for data communication with respect to people and computers using optically inputted information from specialized datum's (sic) on objects and/or natural features of objects." In this patent, a television camera captures game play and provides input to a separate computer. However, disadvantageously, the television camera must be calibrated prior to game play by observing the corners of the game board to establish a reference coordinate system to track markers. An operator must know where to mount the camera and skillfully place the camera directly overhead of the game board, which is a tedious and time-consuming process that distracts from the enjoyment of the game. Further, the entire room is dedicated to accommodate camera focal lengths, illumination and clearance for players. Once the setup is completed, the game board cannot be moved relative to the camera. The players must be sensitive to the placement of the game board because the camera will likely need recalibration if the game board is displaced, which is inevitable during game play. This concern also distracts from the enjoyment of the game. Dismounting the television camera after the game is also a tedious and time-consuming process.

Besides using cameras, electronics have also been used to add excitement and ease of play to board games by using an animated character and a synthesized voice to provide guided play. U.S. Pat. No. 4,799,678, issued to Terzian, et al., for "Electronic Game with Animated Host" discloses a robotic animated character as part of a game assembly that uses a synthesized voice to simulate a game show.

Also note that Capper et al. U.S. Pat. Nos. 5,288,078 and 5,521,616 for "Control interface apparatus" disclose a control interface apparatus which provides a plurality of signal transceivers which may allow a participating player to interactively play a video boxing game with a video character. The Capper et al. apparatus is infrared sensor based, and may be used as a controller interface for use with a video game machine.

The prior art discussed thus far involves either optical recognition of the characteristics of game pieces or of playing cards, the use of a robotic game host with a synthesized voice, or infrared sensor based video game control interfaces. The processes involved in creating and utilizing the software involved in the optical scanning described above can be expensive and complicated and not easily adaptable to modular use with several different games because the optical recognition software and hardware must be created to specifically detect certain characteristics of playing markers and must have certain tolerances for detecting the characteristics while the playing markers are in different positions or even moving.

Accordingly, it would be desirable to have the benefits of using video technology and a synthesized voice for assisted game play without the expense and complications inherent in specific playing marker recognition. This can be accomplished by configuring a mirror, an optical sensor, and various software modules to recognize defined areas on a game board and by measuring changes in the intensity of light reflecting off of those defined areas. This type of design yields a simple, robust, self-aligning, easy to assemble apparatus and method for providing guided game play and more complexity and flexibility in the number of games and software modules that may be used with a single device. The inventions discussed in connection with the described embodiment address these and other deficiencies of the prior art.

The features and advantages of the present inventions will be explained in or apparent from the following description of the preferred embodiment considered together with the accompanying drawings.

SUMMARY OF THE INVENTION

The present inventions address the deficiencies of the prior art of using optical sensors, such as cameras, to enhance board game play by avoiding the need to identify playing markers optically. Particularly, a game tower is placed on or near a game board where the game tower includes a light source, a mirror and a sensor to reflect light to and from game pieces, game cards or areas of the game board that are made of retro-reflective material. Thus, the hardware and the software needed to sense reflected light off of game pieces, game cards or the game board is less complicated, and, therefore, more efficient and more robust than that used in the prior art. Because it is auto-calibrating, as compared to the prior art, calibrating the game tower to recognize areas and spaces on the game board is simpler and more accurate. Additionally, embodiments of the apparatus are capable of surviving typical user abuses during operational life, such as dropping the device, applying torque to the device, and other abuses associated with transportation and aging.

Described embodiments of the inventions provide a game apparatus that includes a light source and a housing disposed around the light source. The housing is made of a low distortion scratch-resistant material that is transparent to the range of wavelengths of light from the light source. A game board is provided as part of the game apparatus. A convex mirror is disposed inside the housing so that light is reflected from the light source, off the convex mirror, through the housing and onto the game board. One or more retro-reflective elements are placed on the game board. These retro-reflective elements receive light emanated from the light source and reflected off of the convex mirror, and, in turn, the retro-reflective elements reflect the light received along substantially the same path from which the light was received. A sensor is also disposed inside the housing. The sensor receives light reflected from the convex mirror off the one or more retro-reflective elements. The sensor detects increases and decreases in the intensity of the reflected light, and, in response to the increases and decreases of reflected light greater than or equal to a predefined level, the sensor generates a data signal. This data is used for storing the locations of the retro-reflective elements along with other game related data in a data store. A processor responsive to data signals from the sensor and from the data in the data store is used to analyze the data and to guide the game that is played using the game apparatus. The data store may be divided into a first data store for storing the locations of the reflective elements and other game-related data used during game play and a second data store for storing one or more discreet data modules wherein each discreet data module is a self-contained, comprehensive collection of all static data necessary for playing a single game.

In one embodiment of the described inventions, the housing is removably mountable in the center of the game board. This embodiment may be accompanied by the game board having a hole in its center and the housing having a flange that securely holds the housing in a fixed position relative to the game board. This setup guarantees that once the light, mirror and sensor are calibrated to accurately detect actions in specific areas of the game board, that calibration will remain accurate and constant. In certain embodiments, the housing may also be keyed to orient the housing to a notch in the game board so that the housing and the game board are consistently aligned. This setup allows proper calibration each time the game apparatus is used. In another embodiment that is suitable for adaptation to many board games, the light source, the convex mirror, and the sensor are vertically aligned along a central axis within the housing, thus allowing for easier calibration.

In certain embodiments, the data store and the processor are disposed within the housing so that the game apparatus is a single, self-contained unit. In other embodiments, the data store and the processor may exist on a separate device, such as a personal computer or an iTouch™ that connects to the game tower through a connection such as a USB cable or other types of cabling.

The described embodiments are such that in response to signals from the sensor and data in the data store, the processor produces sensory output that can provide guided game play. For example, the sensory output may be in the form of an audio instruction for a player to move a game piece or to tell a player that something good or bad happened with regard to that player's standing in the game. Other types of sensory output may also be used. This type of setup is good for having a simulated emcee guide the game play and provide instructions to the players, thus avoiding questions and confusion about the rules of the game.

Several physical characteristics may also appear in embodiments of the described inventions that facilitate the operation of the described inventions by minimizing extraneous light that may cause unwanted glare and undesired operation. For example, a cap may be coupled to the housing to prevent extraneous light from reflecting off of the convex mirror. The convex mirror and the cap may each have a small hole centrally located that can be illuminated for alignment with the light source and the sensor during manufacture. Also, the housing may be tapered to minimize reflections and light not directly from the light source within the housing from reflecting off the convex mirror or reaching the sensor. Additionally, the edge of the convex mirror may be painted to prevent unwanted reflections. Moreover, a shield may be coupled to the bottom of the light source within the housing and a tube may surround the sides of the light source to mask unwanted light originating from the light source from reflecting off the convex mirror. These components may further be placed so that the light source and the convex mirror share the same axis and are aligned to prevent an image of the light source from being detected by the sensor. The sensor is preferably positioned below the light source so that the shield eclipses the reflected light to minimize unwanted glare.

BRIEF DESCRIPTION OF THE DRAWINGS

The inventions will now be more particularly described by way of example with reference to the accompanying drawings. Novel features believed characteristic of the inventions are set forth in the claims. The inventions themselves, as well as the preferred mode of use, further objectives, and advantages thereof, are best understood by reference to the following detailed description of the embodiment in conjunction with the accompanying drawings, in which:

FIG. 10A shows a plan view of a keypad that may appear on a touch screen interface.

FIG. 10B shows a plan view of a rotated keypad as it may appear to a player referenced in FIG. 10A on a touch screen interface when the game player sitting to the left of said player is entering data.

FIG. 10C shows a four-way graphic that may be used as a selection box during joint play using a touch screen interface.

FIG. 10D shows an animated spinning wheel that may be used on a touch screen interface.

DETAILED DESCRIPTION OF THE EMBODIMENTS

Figure 1:
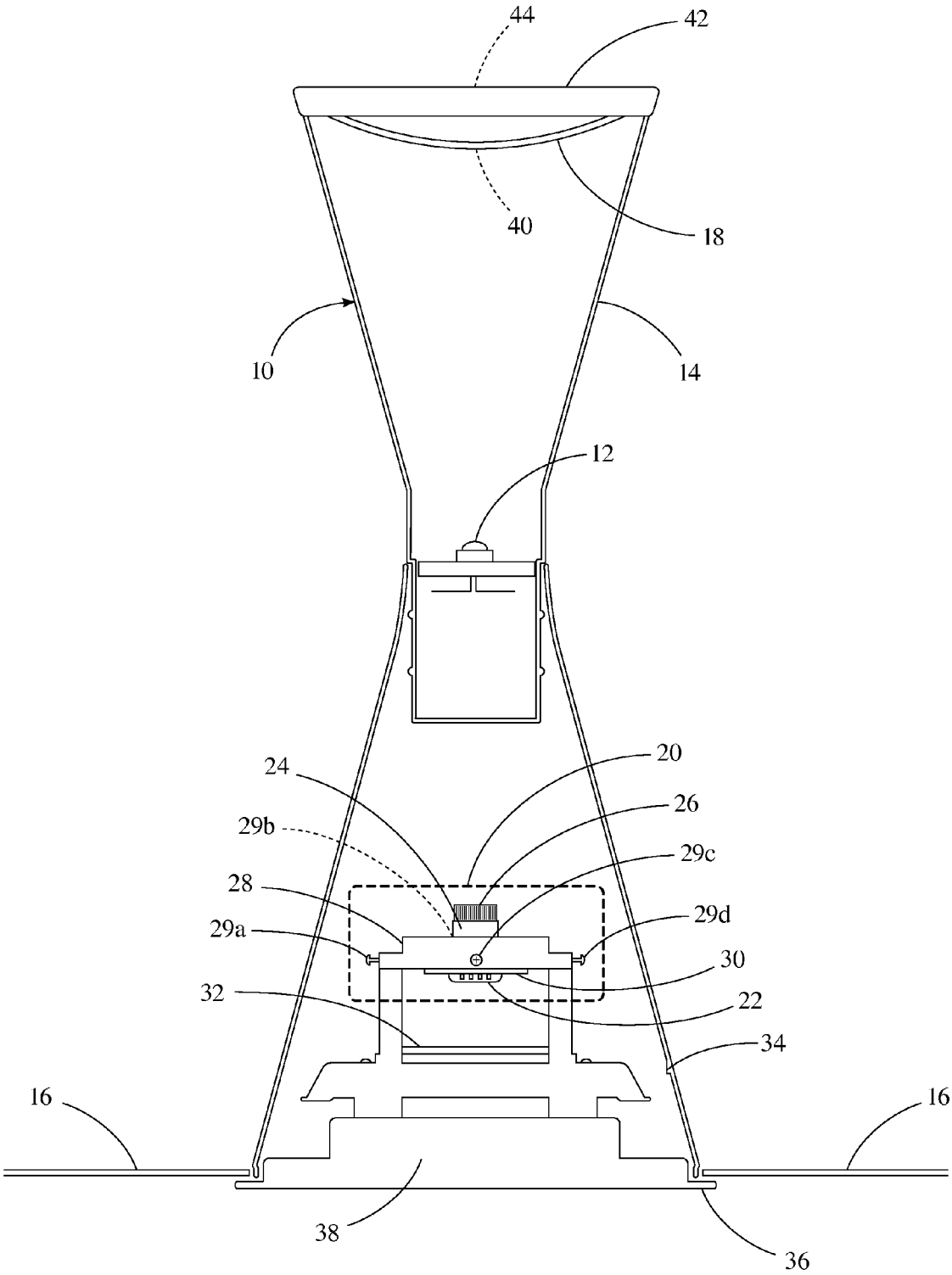
FIG. 1 shows a side elevation view of the assembled game tower as if fully transparent and without wiring.

The described embodiments reveal a game apparatus and a method for playing games. The game apparatus is a game tower that comprises a light source, a convex mirror and an optical sensor, which may be a camera, all disposed within a housing. The housing is transparent to the range of wavelengths from the light source and is composed of a low distortion scratch-resistant material. The apparatus further comprises a game board and one or more retro-reflective elements, such as a moveable playing marker or game token, a card or a region affixed to and integrated into the game board. A data store is used for storing the locations of the reflective elements and other game-related data, such as data needed to measure a player's score or position in a game or data to provide guided play. The data store may be divided into a first data store for storing the locations of the reflective elements and other game-related data used during game play and a second data store for storing one or more discreet data modules wherein each discreet data module is a self-contained, comprehensive collection of all static data necessary for playing a single game. The convex mirror is disposed inside the housing such that light is reflected from the light source, off the convex mirror, through the housing, and onto the game board. The one or more retro-reflective elements, when placed on the game board, receive light emanated from the light source. The light received by the one or more retro-reflective elements is reflected off of the convex mirror and along substantially the same path from which the light was received. The optical sensor receives light reflected from the one or more retro-reflective elements, senses increases and decreases in the intensity of the reflected light, and signals changes in the intensity of the reflected light greater than or equal to a predefined level. A processor, or computer, is responsive to signals from the sensor and the data in the data store. Once the processor identifies a signal from the sensor, the processor can cause actions such as audio or visual output. Thus, the game tower is configured to transform a board game into a computer guidable form that interacts with players in a way that eliminates the need for rule books and allows more functionality in complex game play because rule comprehension is not required.

Embodiments of the apparatus are capable of surviving typical user abuses during operational life, such as dropping the device, applying torque to the device, and other abuses associated with transportation and aging.

In the described embodiment, the game tower, which is battery powered, stands vertically, and the internal components form an integrated retro-reflective coaxial panoramic sensor ("CPS"), a self-contained, modular, compact, self-aligning device that allows the user to conveniently construct and disassemble the components for use and storage. The light source is coaxial to the sensor and located above the sensor to provide maximum retro-reflective illumination and to self-obscure glare in the convex mirror caused by the light source. The sensor, or camera, receives the illumination from the retro-reflective elements on the game board from the mirror and focused through a lens. The components in the game tower are arranged along an axis to provide full illumination and reflection from the edge of the game board to the circumference of the base of the game tower. Game play uses a low resolution optical sensor to detect user input and game piece positions by the presence or the absence of a reflection without discrimination of markers or an analysis of the reflected signals to perceive the type of game piece or marker.

FIG. 1 shows a side elevation view of the assembled game tower 10 as if fully transparent and without wiring. The game tower 10 is shown assembled vertically. A light source 12 is shown with a housing 14 disposed around the light source 12. The housing is transparent to the range of wavelengths of light from the light source 12 and is composed of a low distortion scratch-resistant material. A game board 16 is shown positioned around the game tower 10. In the described embodiments, the game tower 10 will be shown or described in the center of the game board 16. A convex mirror 18 is also disposed inside the housing 14. The convex mirror 18 is shown positioned above the light source 12 so that light from the light source 12 is reflected off the convex mirror 18, through the housing 14, and onto the game board 16.

Figure 2:
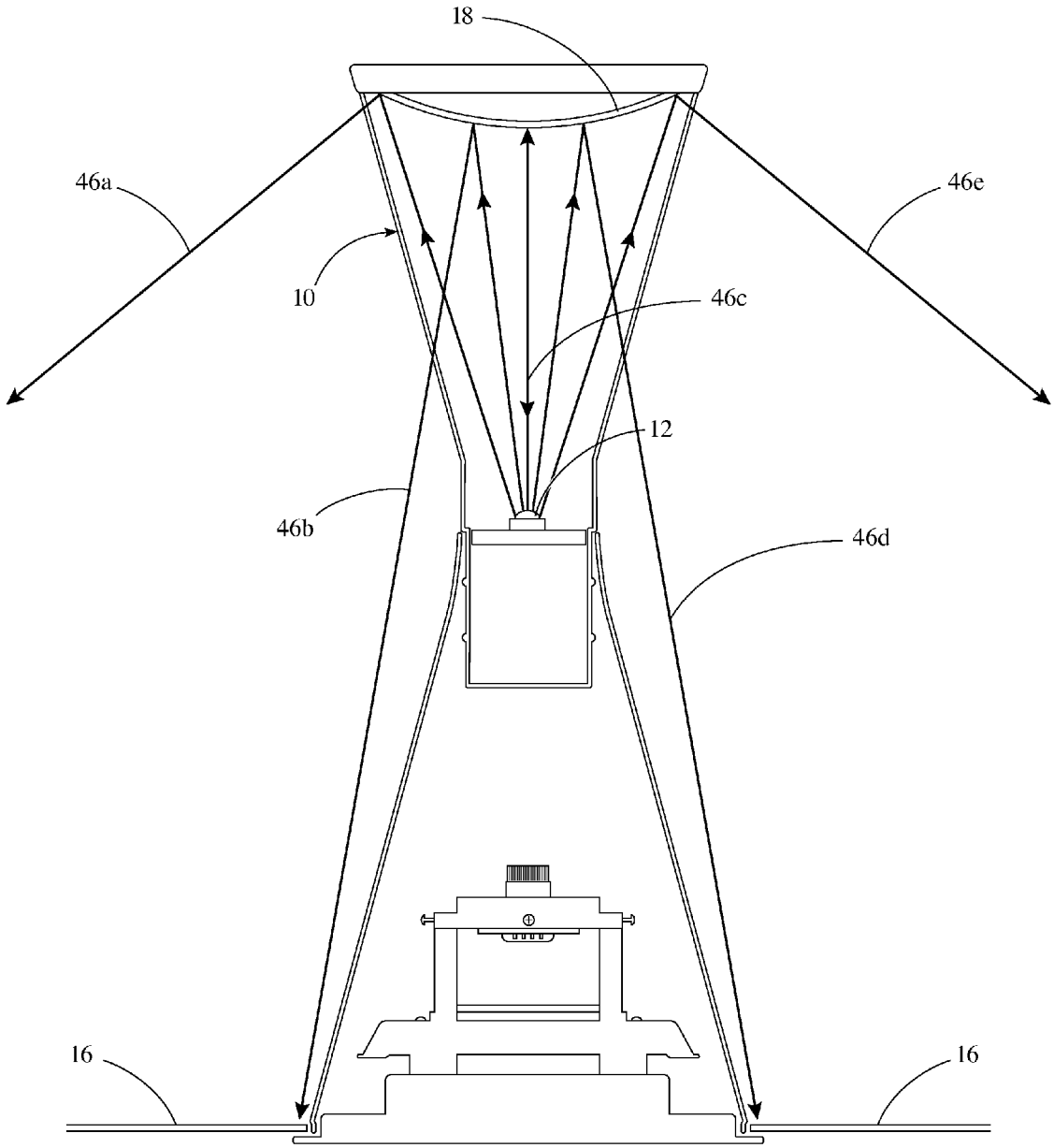
FIG. 2 shows a side elevation view of the assembled game tower as if fully transparent with the pathway of light emitted from an LED and reflected from a convex mirror.

FIG. 2 shows a side elevation view of the assembled game tower 10 as if fully transparent with the pathway of light emitted from an LED and reflected from a convex mirror 18. The outbound light path 46*a*-46*e* is shown emanating from the light source 12 and reflecting off of the convex mirror 18. As can be determined from the arrows showing the outbound light path 46*a*-46*e*, some light in the outbound light path 46*c* will be reflected off of the convex mirror 18 and back to the light source 12. The arrows showing the outbound light path 46*a*-46*e* also show how the range of reflected light is configured and calibrated to create an outbound light path 46*a*, 46*e* that extends to the edges of the game board 16 and an outbound light path 46*b*, 46*d* that extends to the base of the game tower 10. Inductively, the outbound light path 46*a*-46*e* covers the entire area from the edges of the game board 16 to the base of the game tower 10.

Figure 3:
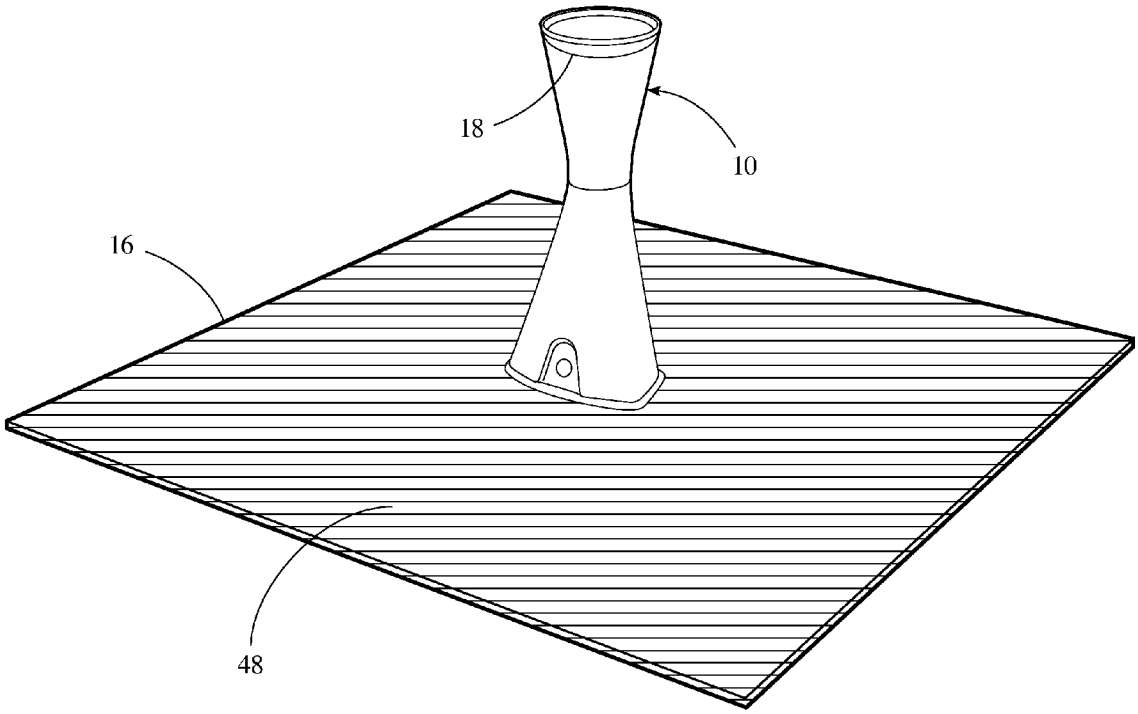
FIG. 3 shows a perspective view of game tower positioned in the center of a game board and the area covered by outwardly reflected light.

FIG. 3 shows a perspective view of game tower 10 positioned in the center of a game board 16 and the area covered by outwardly reflected light 48. The area covered by outwardly reflected light 48 is the area to be monitored during game play. During game play, one or more retro-reflective elements are placed on the game board 16 and will affect game play when in the area covered by outwardly reflected light 48 by reflecting light back to the convex mirror 18. The retro-reflective elements comprise at least one of a game token, a card, and a region affixed to the game board 16.

Referring again to FIG. 1, light that is reflected from the light source 12, off the convex mirror 18, and onto the game board 16 will reach retro-reflective elements on the game board 16 and be reflected along substantially the same path back through the housing 14, off of the convex mirror 18, and to the sensor 20, which may be a camera. As shown, the sensor 20 comprises a sensor chip 22, a lens 24, a lens focus 26, a lens plate 28 and a printed circuit board ("PCB") 30. In the described embodiment, the lens 24 is mounted to a lens plate 28 and a lens focus 26 is attached to the lens 24, to comprise the lens mechanism. The lens focus 26 is used to adjust the focus from the lens 24 to the sensor chip 24. The sensor chip 22 is mounted on the PCB 30. The lens mechanism is further mounted atop the PCB 30 so that light directed through the lens focus 26 and into the lens 24 will reach the sensor chip 22. One or more lens adjustment screws 29*a*-29*d* may be mounted to the lens plate so that the lens mechanism may be adjusted to properly align to the sensor chip 22 to accommodate for variations in tolerances caused by chip mounting.

Figure 4:
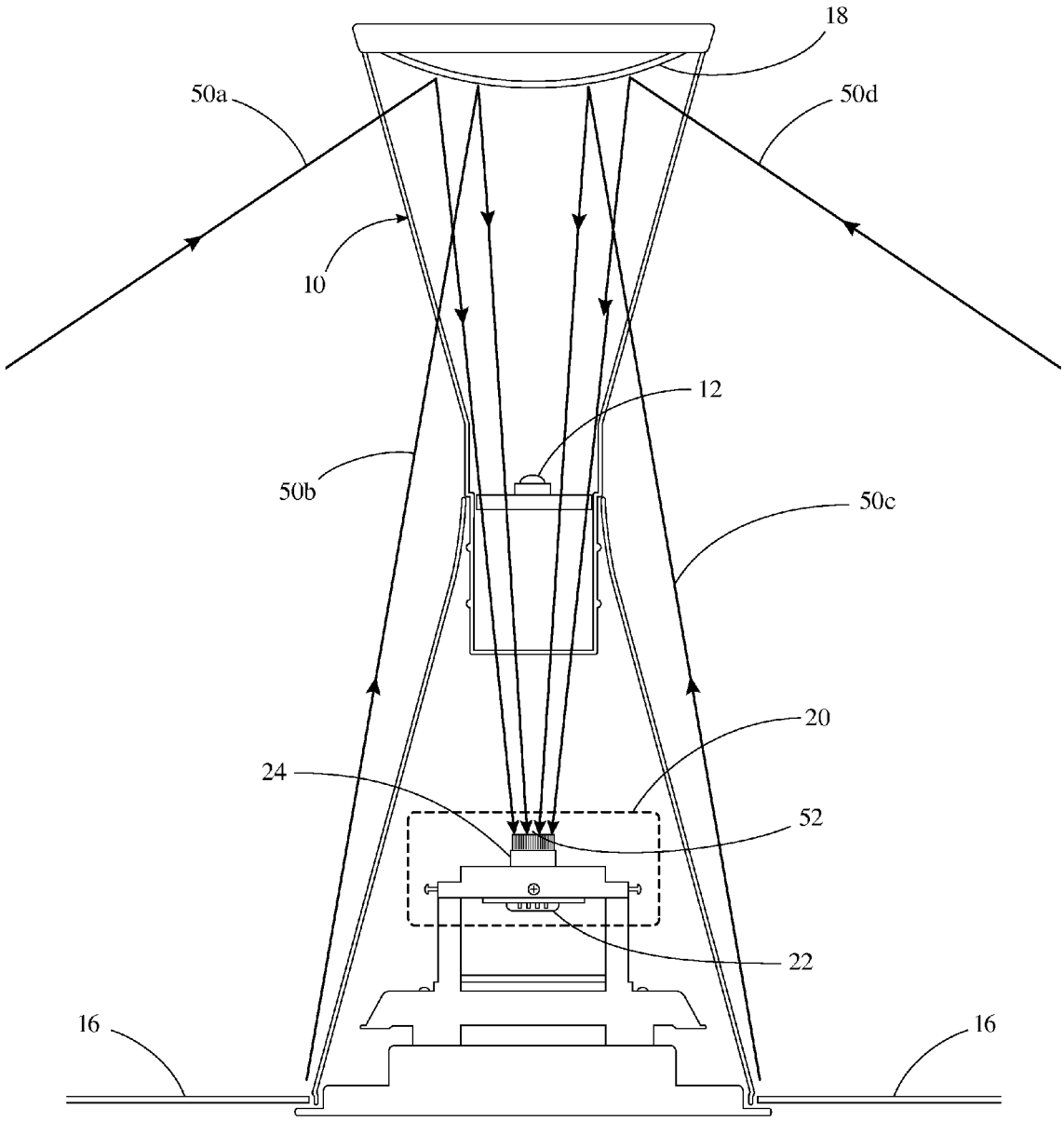
FIG. 4 shows a side elevation view of the assembled game tower as if fully transparent with the pathway of light reflected from the retro-reflective elements on the game board to the sensor.

FIG. 4 shows a side elevation view of the assembled game tower 10 as if fully transparent with the pathway of light reflected from the retro-reflective elements on the game board 16 to the sensor 20. The inbound light path 50*a*-50*d* is shown emanating from areas of the game board 16 that may have retro-reflective elements, off the convex mirror 18, and to the sensor 20. Specifically, the inbound light path 50*a*-50*d* is shown reaching the lens focus 26, where it will be directed through the lens 24 and into the sensor chip 22. Note that some inbound light reflecting off the convex mirror 18 will be blocked by the light source 12. Additionally, a portion of the interior of the convex mirror 18 will not receive reflected light because of the area covered by the base of the game tower 10. The inbound light path 50*b*, 50*c* is shown with a blocked light gap 52 that is caused by inbound light blocked by the light source 12 and by the area covered by the base of the game tower 10. The blocked light gap 52 results in an area on the sensor chip 22 that will not sense reflected light.

Figure 5A:
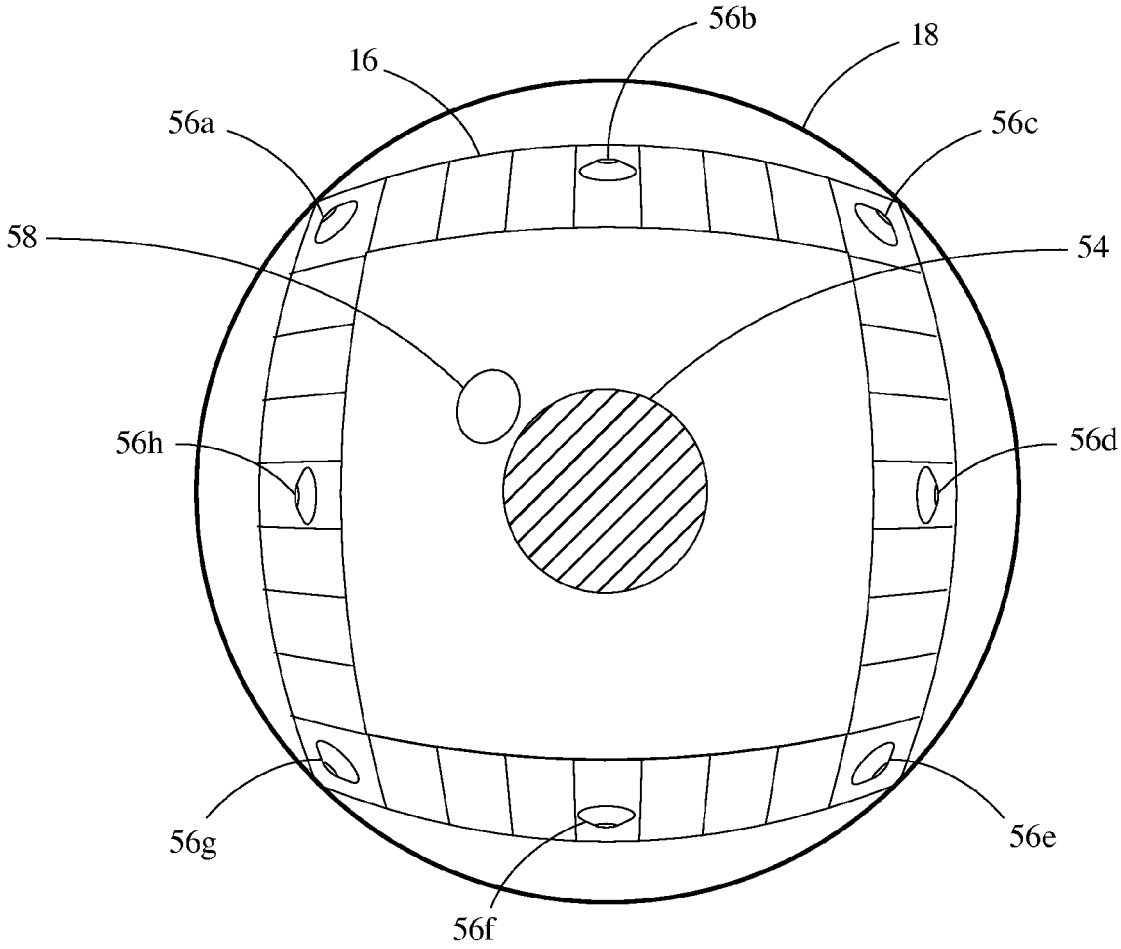
FIG. 5A shows a view of the convex mirror from the perspective of the sensor chip.
Figure 5B:
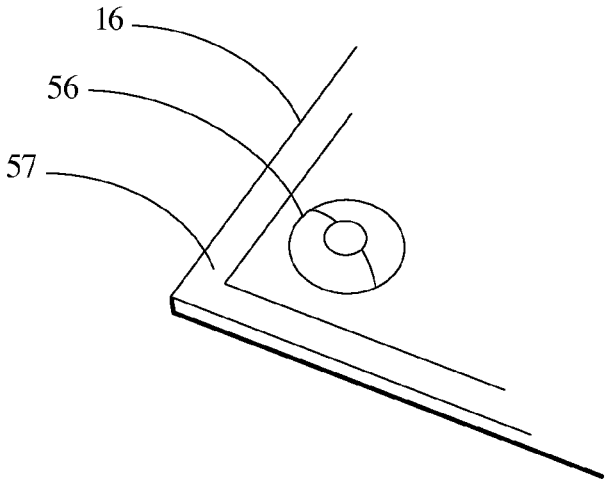
FIG. 5B shows a sample moveable game piece in the corner of the game board.

FIG. 5A shows a view of the convex mirror 18 from the perspective of the sensor chip 22. There will be a dark spot 54 in the center of the convex mirror 18 that represents the area of the convex mirror 18 that cannot be reached by light reflected from retro-reflective elements because the inbound light path 50*a*-50*d* is blocked by the body of the light source 12 and by the area covered by the base of the game tower 10. The dark spot is an eclipse that masks the glare of the coaxial light source 12. The eclipse is geometrically identical to the diameter of the tower's base. An image of the game board 16 is shown as it appears on the convex mirror 18. FIG. 5B shows a sample moveable game piece 56 in the corner of the game board 16. In FIG. 5A, the reflection from retro-reflective moveable game pieces 56*a*-56*h* are shown as two-dimensional reflections of the three-dimensional game piece. Because in the described embodiments the optical sensor 20 does not identify particular game pieces, it is not necessary for the sensor 20 to process the two-dimensional image into a three-dimensional representation of the actual game piece. Also in FIG. 5A, a retro-reflective region 58 is shown affixed to and integrated into the game board 16. When the pathway from the light source 12 to a retro-reflective region 58 and back to the sensor 20 is unimpeded, the retro-reflective region 58 will be appear on the convex mirror as constant illumination.

As the users move the game pieces around the game board 16 during game play, the reflection from the retro-reflective moveable game pieces 56*a*-56*h* will move and the sensor 20 will detect this movement. Thus, in response to the movement of the game pieces, the sensor 20 will be able to produce signals reflecting the movement, and a processor will be able to monitor, record and react to such movement. Likewise, if a retro-reflective region 58 is covered, the sensor will 20 detect the interruption of the constant illumination and will be able to produce signals reflecting the interruption. A processor will be able to use this mechanism to use retro-reflective regions 58 as switches during game play. In other words, one or more retro-reflective elements placed on the game board 16 may receive light emanated from the light source 12 and reflected off of the convex mirror 18 and reflect said light along substantially the same path from which the light was received. Then, the sensor 20, which is disposed inside the housing 14, receives light reflected from the one or more retro-reflective elements, senses increases and decreases in the intensity of the reflected light, and signals changes in the intensity of the reflected light greater than or equal to a predefined level. A processor may then be used to interpret the signals from the sensor 20.

A retro-reflective edge 57 of the game board 16 is shown in FIG. 5B. This retro-reflective edge 57 can be used during initial game setup to allow a processor to calibrate and calculate the dimensions of the game board 16. Likewise, fixed retro-reflective areas, or "buttons", on the game board may also be used for calibration in a similar fashion.

Referring back to FIG. 1, the game tower 10 may integrate other features. A speaker 32 may be mounted inside the game tower 10 to provide audio output. Further, a battery compartment 38 may be used to eliminate the need for an external power source.

In the described embodiment, several features may be integrated to simplify the calibration and configuration of the game tower 10 with respect to particular game boards as well as to reduce unwanted glare and reflection from the light source 12 and from outside light sources. To simplify the calibration and configuration of the game tower 10 with respect to particular game boards, a game board 16 may be designed with a hole in the center so that the game board 16 may be slipped over the game tower 10 and put into place. A flange 36 may be added to the base of the game board 16 to cause the relative positions of the game tower 10 and the game board 16 to remain constant and unchanged, thereby securely holding the housing 14 in a fixed position relative to the game board 16. Additionally, a notch 34 may cut into the game tower 16 housing 14 that can be aligned with the game board 16 to ensure simple and exact calibration and configuration each time the game is assembled. Thus, in the described embodiment, the housing 14 is removably mounted at the center of the game board 16, the game board 16 has a hole in the center for said removable mounting, and the housing 14 is keyed to orient the housing 14 to a notch 34 in the game board 16 so that the housing 14 and the game board 16 are consistently aligned. Likewise, fixed gaming elements on the board can be used.

To reduce unwanted glare and reflection, a cap 42 may be coupled to the housing 14 to prevent light extraneous to the light source 12 from reflecting off of the convex mirror 18. Additionally, the edge of the convex mirror 18 may be painted to reduce unwanted reflection. Moreover, the housing 14 may be tapered to minimize light not directly from the light source 12, such as reflections and light directly from somewhere other than the light source 12. Another way to reduce extraneous light is to vertically align the light source 12, the convex mirror 18, and the sensor 20 along a central axis within the housing 14. Where the light source 12 and the convex mirror 18 are aligned to share the same axis, the alignment prevents an image of the light source 12 from being detected by the sensor 20. Thus, aligning the light source 12 and the convex mirror 18 along a common axis so that light that is reflected from the light source 12 to the convex mirror 18, off the one or more retro-reflective elements, coaxially back off the convex mirror 18, and to the sensor 20, is eclipsed by the light source to prevent unwanted glare while maintaining a panoramic area illuminated by the light source 12.

To aid in proper calibration and reflection reduction during manufacture, a small mirror alignment hole 40 (hole not shown) may be centrally located in the convex mirror 18 and a small cap alignment hole 44 (hole not shown) may be centrally located in the center of the cap 42 to test alignment with illumination from the light source 12 and the sensor 20.

Figure 6:
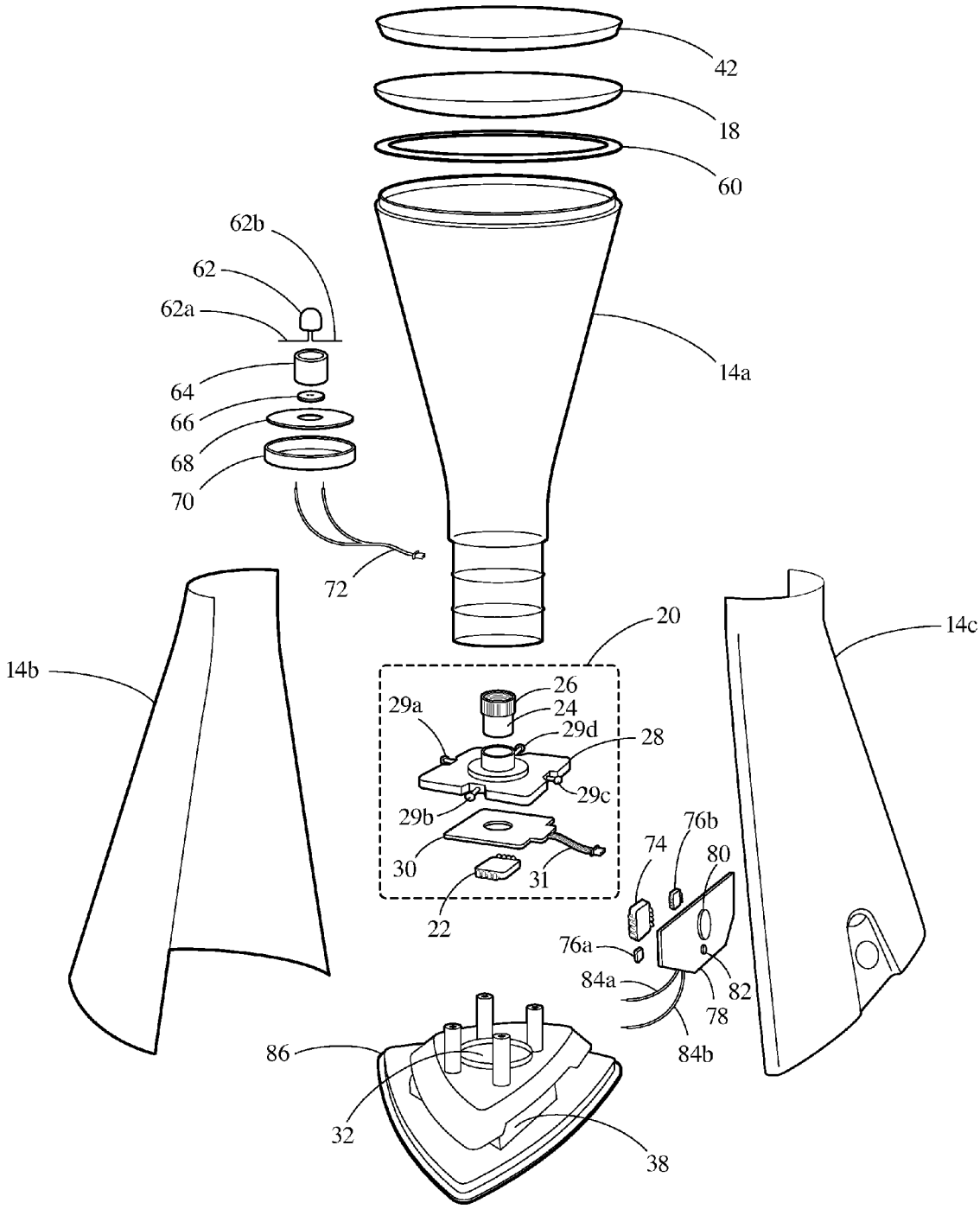
FIG. 6 shows an exploded view of the game tower and its components.

FIG. 6 shows an exploded view of the game tower 10 and its components. The housing 14*a*-14*c* is shown as an assembly of three pieces where all the components of the game assembly form one unit when assembled. The top of the assembly is show with the cap 42, the convex mirror 18 and a rubber ring 60 aligned to fit on top of a ridge in the top portion of the housing 14*a*. The rubber ring 60 may be used to hold the convex mirror 18 and the cap 42 in place as well as to block unwanted light. The game assembly is supported on the bottom by an assembly base 86, which includes the speaker 32 and the battery compartment 38.

The assembly that includes the light source 12 is shown as an LED 62 with two LED leads 62*a*-62*b* that connect to the LED connectors 72, which, through other components, are connected to the batteries in the battery compartment 38. This assembly includes a tube 64 that surrounds the LED 62 and a shield 66 that is mounted under the LED 62. The shield 66 has two small holes for the LED leads 62*a*-62*b* to feed through. The LED 62, the tube 64 and the shield 66 are mounted onto a clear shelf, which is mounted to a ring 70 that attaches to the top portion of the housing 14*a* in the described embodiment. The shield 66 is coupled to the bottom of the light source 12 and the tube 64 surrounds the sides of the light source 12 to mask unwanted light originating from the light source 12 from reflecting off the convex mirror 18. The sensor 20 is positioned below the light source 12 so that the shield 66 eclipses the reflected light to minimize unwanted glare. The assembly that includes the sensor 20 is shown as a lens 24, a lens focus 26, a lens plate 28 with four lens adjustment screws 29*a*-29*d*, a PCB 30, and a sensor chip 22, which are coupled in the order shown in FIG. 6 and function as described earlier. The PCB cable 31 is used to receive power and to provide signals from the sensor chip 22 to a processor 74.

The assembly that includes the processor 74 is shown as a controller board 78 to which the processor 74 and a data store, which in the described embodiment is split between a RAM data store 76*a* and a ROM data store 76*b*, are coupled. In the described embodiment, the controller board 78 also includes a volume control 80, a reset button 82, and speaker wires 84*a*-84*b* or connectors to other sensory output mechanisms. The RAM data store 76*a* and the ROM data store 76*b* are used for storing the locations of the reflective elements and other game-related data, such as data needed to measure a player's score or position in a game or data to provide guided play. The processor 74 is responsive to signals from the sensor 20 and the data in the RAM data store 76*a* and the ROM data store 76*b*. That is, the processor 74 produces sensory output, such as audio and video, in response to signals from the sensor 20 and data in the RAM data store 76*a* and the ROM data store 76*b*, and this sensory output provides guided game play as will be described below. In the embodiment described thus far, the RAM data store 76*a*, the ROM data store 76*b* and the processor 74 are disposed within the housing 14*a*-14*c*, however, as will be shown, other configurations are contemplated.

Figure 7:
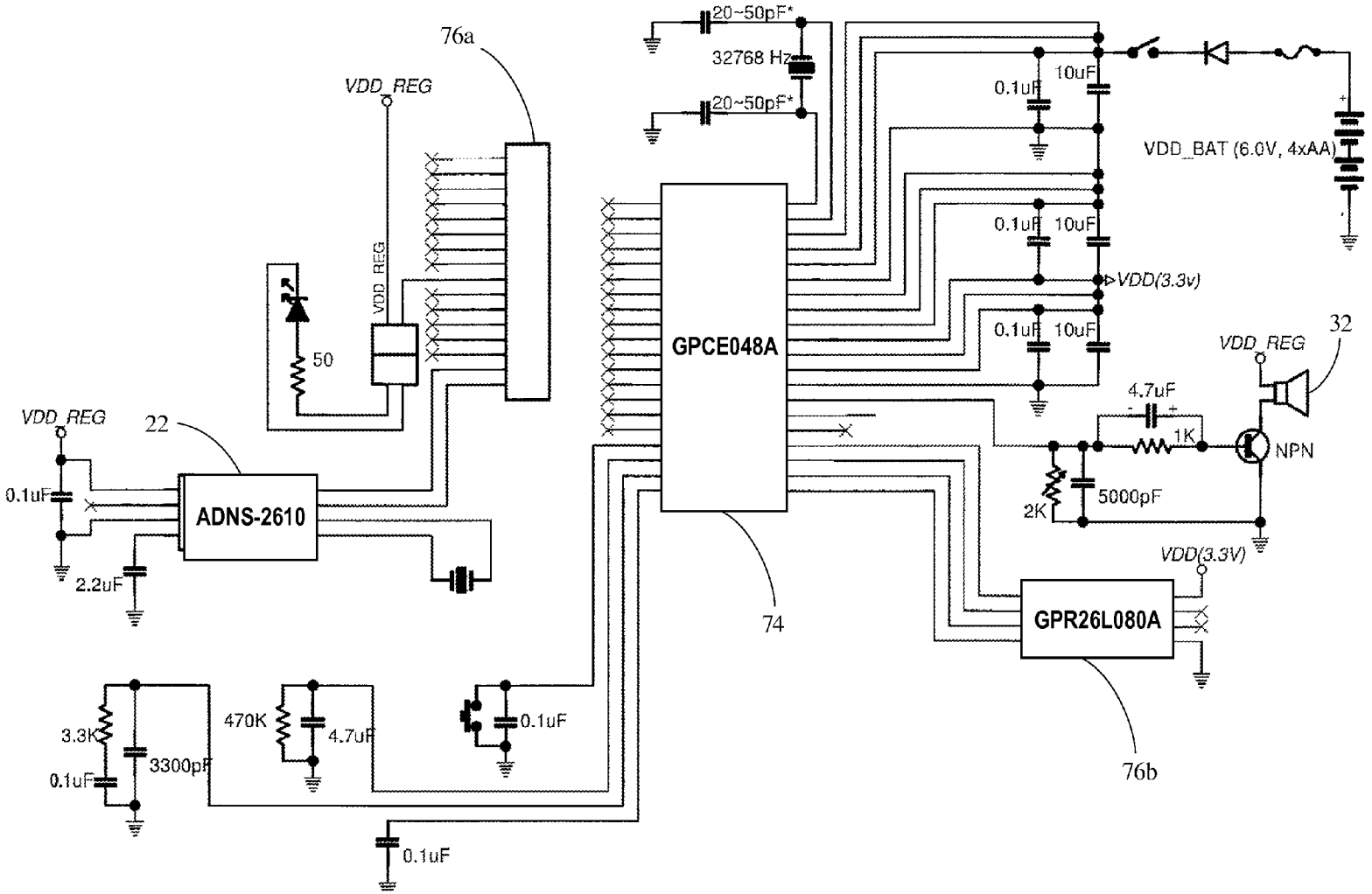
FIG. 7 shows a wiring diagram of the game tower.

FIG. 7 shows a wiring diagram of the game tower 10 in accordance with some embodiments. The processor 74 is coupled to the speaker 32, the RAM data store 76*a*, the ROM data store 76*b*, and the sensor 22. The processor 74 receives and analyzes signals from the sensor 22 to determine when a reflective element is reflecting or when a reflection is interrupted. The processor 74 drives the speaker 32 depending on the state of the game. The ROM data store 76*b* stores the game algorithm, audio clips, and other relevant, static data. The RAM data store 76*a* stores states of the game play, game piece position, and other relevant, dynamic data. The sensor chip 22 is shown as the Avago Technologies ADNS-2610 optical sensor, although other optical sensors may be used. The processor 74 is shown as the Generalplus Technologies GPCE048A 16-bit sound controller, although other processors may be used. The ROM data store 76*b* is shown as the Generalplus Technologies GPR26L080A although other ROM devices may be used.

Figure 8A:
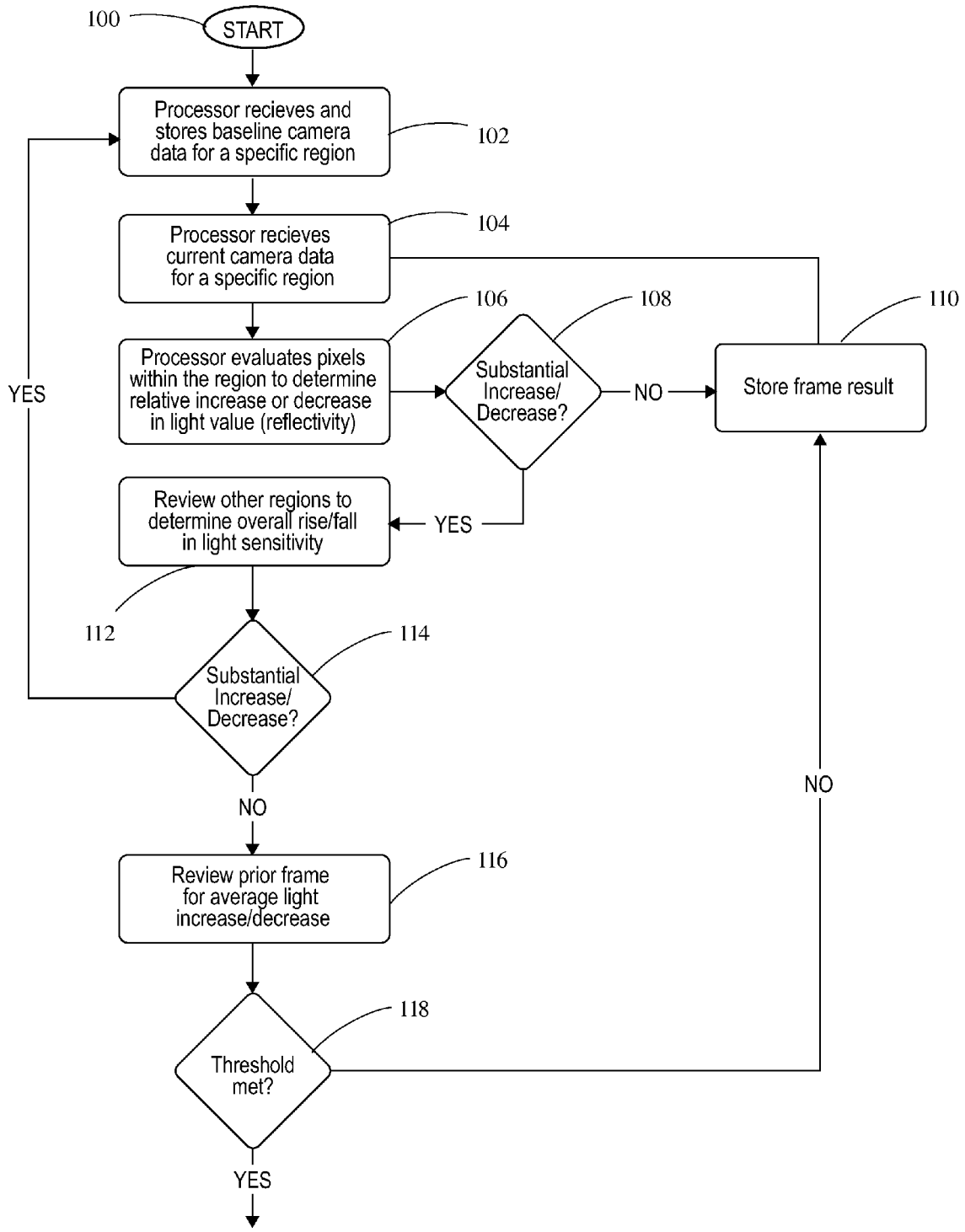
FIG. 8A and FIG. 8B combined show a flow chart for the logical decision making during the operation of the game tower.
Figure 8B:
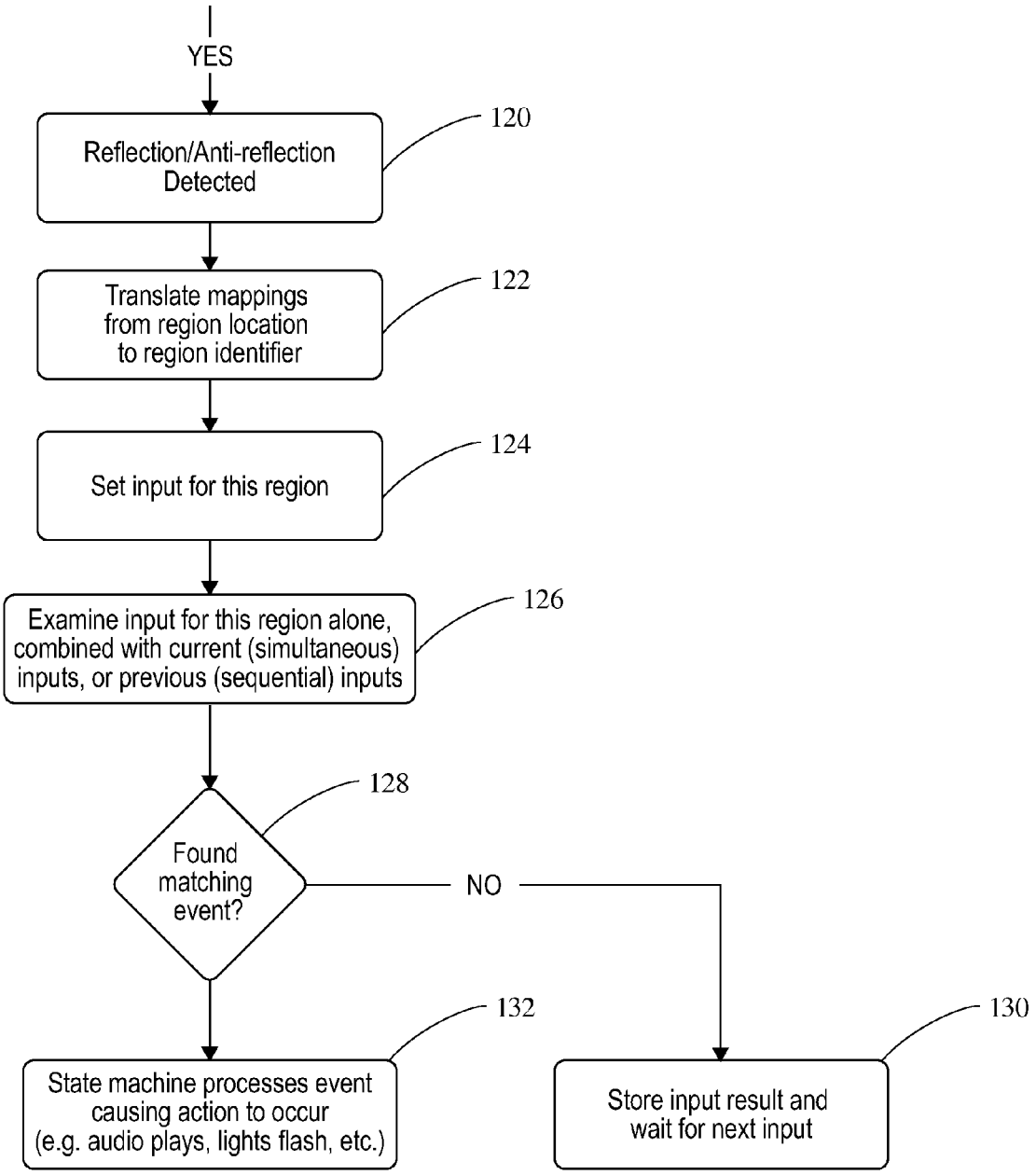

FIG. 8A and FIG. 8B combined show a flow chart for the logical decision processing for setting up game data and detecting changes in the reflected light during the operation of the camera based game tower 10, which is based on changes in the intensity of light reflected from retro-reflective elements positioned on the game board 16. This retro-reflective change decision process 100 begins with step 102 where the processor 74 receives and stores baseline camera data for a specific region. In the described embodiment, this occurs after the game tower 10 is mounted in the center of the game board 16 and the game tower 10 is turned on. The processor 74 uses data in the RAM data store 76*a* and the ROM data store 76*b* to determine the baseline camera data for the game and step 102 is performed.

In the described embodiment, data in the RAM data store 76*a* and the ROM data store 76*b* is used to define the game board 16 in terms of regions. For example, when a typical board game is considered, each space on the board may be considered a different region that has predetermined dimensions. These correspond to physical regions on the board, such as properties in Monopoly™. Additionally, retro-reflective elements may be placed on the game board 16 to allow control of game functions and data in the RAM data store 76*a* and the ROM data store 76*b* may be used to define the locations of those elements. In step 104, the processor 74 receives current camera data for a specific region. In step 106, the processor 74 evaluates pixels within the region to determine the relative increase or decrease in the value of the light reflectivity. In step 108 the processor 74 determines whether the measured reflectivity represents a substantial increase or decrease in the light intensity from the region. If there has not been a substantial increase or decrease in the light intensity from the region, in step 110 the processor 74 stores the result of the frame for the region. If there has been a substantial increase or decrease in the light intensity from the region, the processor 74 in step 112 reviews other regions to determine overall rise or fall in light sensitivity. In step 114, the processor 74 determines if there has been a substantial overall rise or fall in light sensitivity. If there has been a substantial overall rise or fall in light sensitivity, step 102 is repeated. This compensates for changes in ambient light conditions that might affect game play.

If there has not been a substantial overall rise or fall in light sensitivity, in step 116, the processor 74 reviews the prior frame for the average light intensity increase or decrease. The processor 74 in step 118 determines whether or not any increase or decrease reaches a predetermined threshold. If the threshold is not met, step 110 is repeated. If the threshold is met, the processor 74 determines whether reflection or anti-reflection is detected in step 120. In step 122, the processor translates mappings of the region from region location to region identifier and step 124 is used to set the input for the region. In step 126, the processor 74 examines the input for the region alone, combined with current (simultaneous) inputs, or combined with previous (sequential) inputs. In step 128, the processor 74 determines whether a matching event was found. If no matching event was found, then, in step 130, the processor 74 stores the input result and waits for the next input. This is the basis for determining the position and movement of game pieces on the board. When a matching event is found, in step 132, the state machine processes the event, causing an action to occur, such as an audio instruction or some visual stimulus. The state machine consists of game rules, game data and game stimuli associated with a specific game title.

Figure 9:
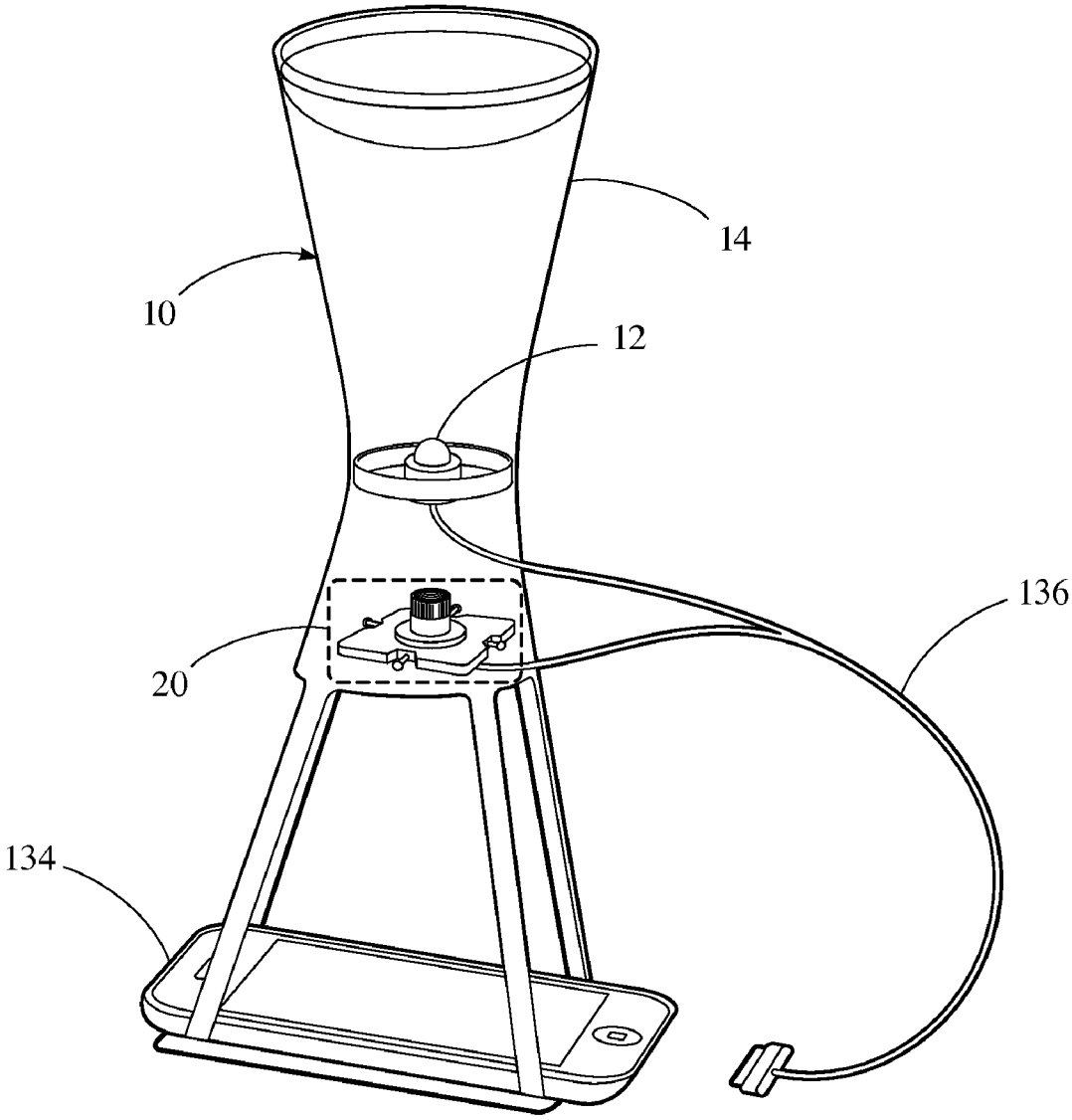
FIG. 9 shows a perspective view of the game tower with an open bottom to facilitate using an external data store and an external processor.

FIG. 9 shows a perspective view of the game tower 10 with an open bottom to facilitate using an external data store and an external processor. In this configuration, the processor 74, the RAM data store 76*a*, the ROM data store 76*b*, the state machine, the output peripherals, such as the speaker 32, and the power source are external to the housing 14 and provided by an external device 134 such as an iTouch™, an iPhone™, a laptop computer, or any other similar external device. In this open bottom configuration, the light source 12 and the sensor 20 are still disposed within the housing 14 and use the external device 134 to supply power through an external connector 136. Consequently, the benefits of the external device 134, such as better input mechanisms and more avenues for sensory output, may be used. Communication between the game tower 10 and external components may also be accomplished using Blue Tooth™ or WiFi technology and also take advantage of benefits offered by using cloud computing.

FIG. 10A through FIG. 10D show a sample of various inputs that may be used when an external device 134 with touch screen technology is used. FIG. 10A shows a plan view of a keypad 138 that may appear on a touch screen interface. Use of the keypad 138 may make inputting data during setup and during game play more convenient than using retro-reflective switching for certain tasks. FIG. 10B shows a plan view of a rotated keypad 140 as it may appear to a player referenced in FIG. 10A on a touch screen interface when the game player sitting to the left of said player is entering data. FIG. 10C shows a four-way graphic that may be used as a selection box 142 during joint play using a touch screen interface. For example, the selection box 142 may be used to select playing pieces that are associated with various players. In the shown selection box 142, a player wanting to use the car as a playing marker must simply touch the area with the car. FIG. 10D shows an animated spinning wheel 144 that may be used on a touch screen interface.

Figure 11:
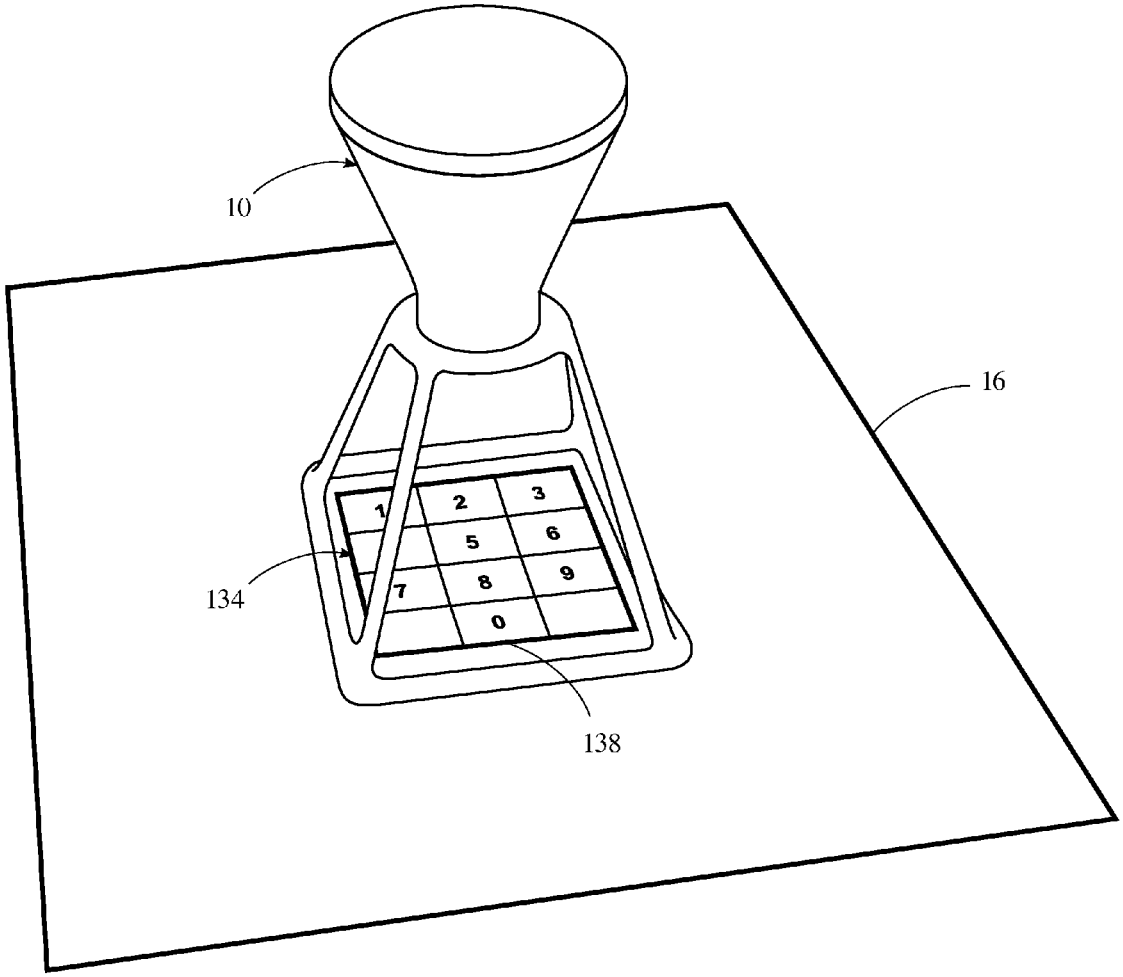
FIG. 11 shows a perspective view of the game tower with an open bottom to facilitate using an external data store and an external processor that is part of a device mounted under the game board.

FIG. 11 shows a perspective view of the game tower 10 with an open bottom to facilitate using an external data store and an external processor that is part of a device mounted under the game board 16. In this configuration, the game board 16 is designed to be mounted over the game tower 10 and the external device 134 so that the keypad 138 is the only portion of the external device 134 showing.

Use of a first data store and a second data store as described above allow for the creation of plug-in software modules that can be connected to the game tower 10 depending on the game to be played. Following are examples of two such games that may be played and controlled by separate data modules.

Figure 12:
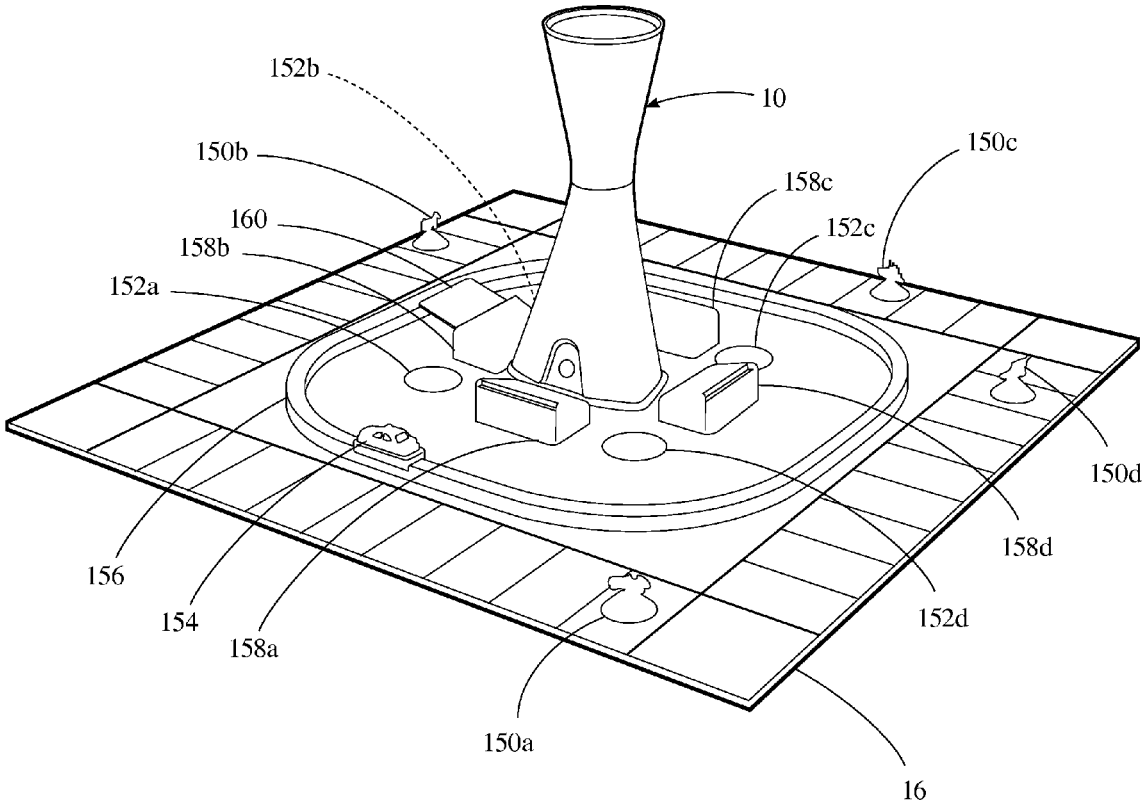
FIG. 12 shows a perspective view of a game setup that may be used to play a game such as Monopoly™.
Figure 13:
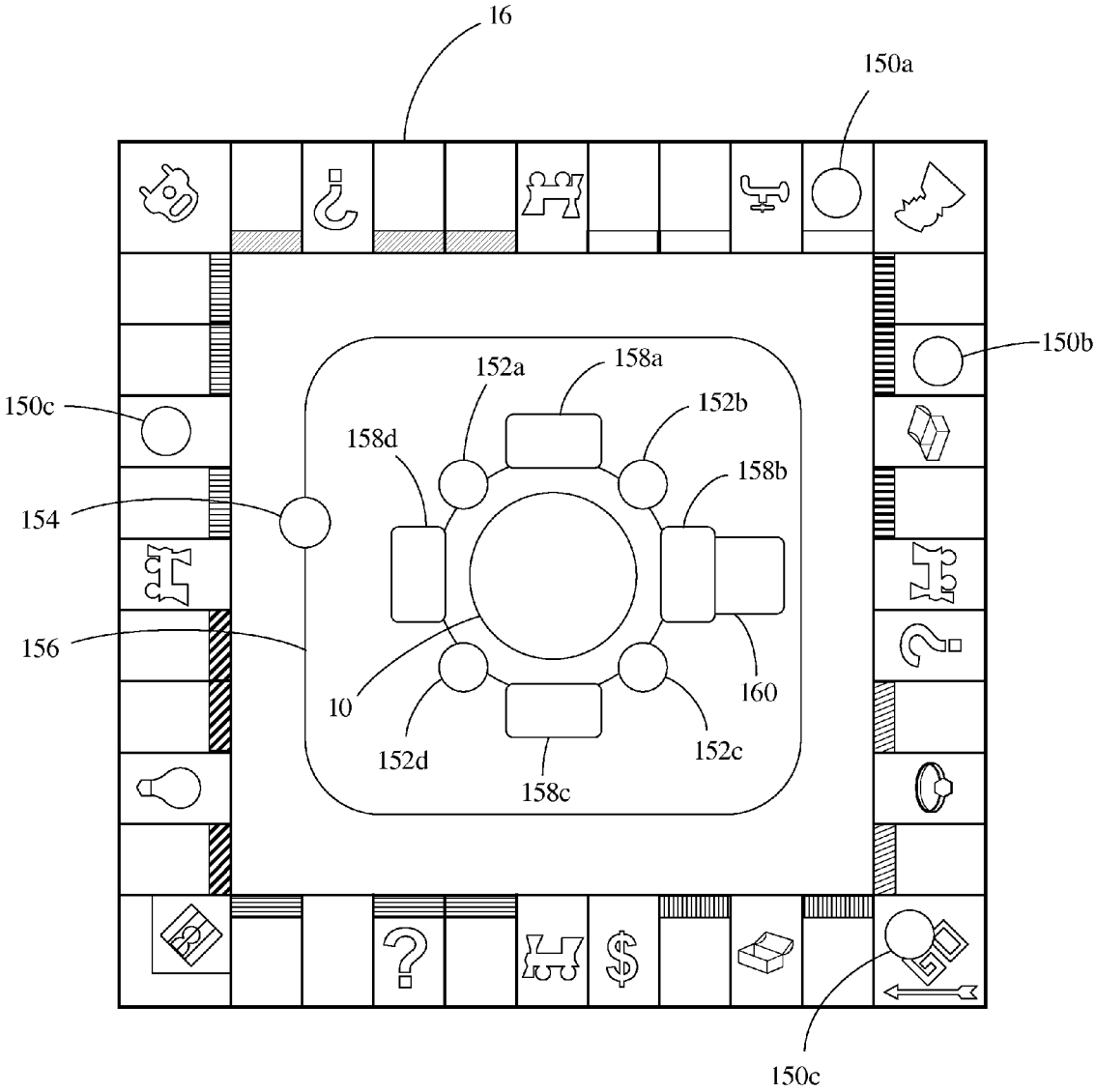
FIG. 13 shows a plan view of a setup that may be used to play a game of Monopoly™.

FIG. 12 shows a perspective view of a game setup that may be used to play a game such as Monopoly™. FIG. 13 shows a plan view of a setup that may be used to play a game of Monopoly™. In both of these figures, Monopoly™ game tokens 150*a*-150*d* are shown and represent the familiar Monopoly™ game tokens 150*a*-150*d*, such as the dog, the iron, the car and the wheelbarrow; however, in the described embodiment, the Monopoly™ game tokens 150*a*-150*d* are made of a retro-reflective material. Unlike the traditional Monopoly™ game, the game board 16 shown in FIG. 12 and FIG. 13 includes Monopoly™ retro-reflective regions 152*a*-152*d*, a shooter 154, which is a retro-reflective element that moves easily along a track 156 and allows additional game functionality, several ATMs 158*a*-158*d*, and one or more Monopoly™ retro-reflective cards 160. The Monopoly™ game tokens 150*a*-150*d* and the other non-traditional retro-reflective elements just described allow for an increased number of playing options during game play, thus providing for a more exciting and more robust version of the traditional game. Moreover, because the game tower 10 provides guided play, the game player does not have to worry about learning and memorizing too many rules.

All of the aforementioned retro-reflective elements used to play Monopoly™ act as switches that are controlled by changes in the intensity of light reflected off of these retro-reflective elements. For example, each player gets one of the Monopoly™ game tokens 150*a*-150*d*. The players use the Monopoly™ game tokens 150*a*-150*d* as in the traditional version of the game with added functionality. The game tower 10 uses the reflection off of the Monopoly™ game tokens 150*a*-150*d* to keep track of where the tokens are located on the game board 16. Although the game tower 10 does not identify the Monopoly™ game tokens 150*a*-150*d*, by knowing the locations of the tokens and by gathering information during game setup, the game tower 10 can keep track of how much money a player has, what properties a player owns, how many houses and hotels each property has, and any other relevant game statistics. The reflective quality of the Monopoly™ game tokens 150*a*-150*d* also allows each player to roll the dice by covering the token with a hand.

FIG. 12 and FIG. 13 also show Monopoly™ retro-reflective regions 152*a*-152*d*. These retro-reflective elements are also used as switches. In the described embodiment, the Monopoly™ retro-reflective regions 152*a*-152*d* are used for decision making and for answering questions that are asked by the game tower 10. Of the four Monopoly™ retro-reflective regions 152*a*-152*d* shown in FIG. 12 and FIG. 13, two regions may be labeled "YES" and two regions may be labeled "NO". Thus, a player wanting to answer "YES" to a question asked by the game tower 10 will cover the region labeled "YES" with a hand. A player wanting to answer "NO" to a question asked by the game tower 10 will cover the region labeled "NO" with a hand. Some questions that the game tower may ask are, "Do you want to but that property?" or "Do you want to end the game?", etc. In the described embodiment, the region labeled "YES" is also used to build houses or hotels or to unmortgage a property. The region labeled "NO" is also used to sell houses or hotels or to mortgage a property. When the region labeled "YES" and the region labeled "NO" are covered simultaneously, a repeat function is initiated.

The taxi, or shooter 154, is a retro-reflective element on a track 156 that circles the game board 16 near the center. In Monopoly™, the shooter 154 is shaped like a taxi cab and allows players to receive random cab rides, where a player gets to push the shooter 154 along the track 156 and move to where the shooter 154 lands. The shooter 154 may also be used in certain mini-games that are not part of the traditional Monopoly™, such as a game where a player must aim for a specific landing target and try to land as close to that target as possible. The shooter 154 is also used as a selection tool for mortgaging property, selling property, improving property, trading property, etc. To use the shooter 154 as a selection tool, a player moves the shooter 154 along the track 156 to a particular property or cash amount and covers the region labeled "YES" with a hand. The cash amounts may be represented as a retro-reflective element along the track 156 and be labeled in denominations such as "$1", "$5", etc.

The ATMs 158*a*-158*d* are used in conjunction with a Monopoly™ retro-reflective card 160. Each player gets one card. When a player inserts the card into an ATM 158*a*-158*d* between turns, an ATM menu is activated from which players learn how much money they have and can choose to perform functions such selling, building and other actions as described above. If two players simultaneously insert Monopoly™ retro-reflective cards 160, a trading menu is activated to allow players to trade properties, cash or both. Monopoly™ retro-reflective cards 160 may also be used in mini-games, such as in horse races and stock market buying and selling as well as other possible mini-games. The Monopoly™ retro-reflective card 160 may also be used to bid in auctions.

The game tower 10 uses all these elements to provide guided play and to track all player transactions and statistics. As an example, the game tower 10 guides setup of the game to store the data necessary to guide the game without having to identify specific playing tokens. After setup, the game tower 10 will tell a player to roll the dice by covering that player's game piece and make sure that the player moves the game piece to the proper space along with any appropriate audio (and, in some embodiments, video or other feedback). The game tower 10 will then tell the player his or her options, such as pay rent, buy the property, etc. The game tower 10 guides any transactions, which may involve mini-games or use of an ATM 158*a*-158*d*. When a player has finished his or her turn, the game tower 10 will guide the next player and so on until a game is completed. The foregoing provides various exemplary functions to enhance the game of Monopoly™.

Figure 14:
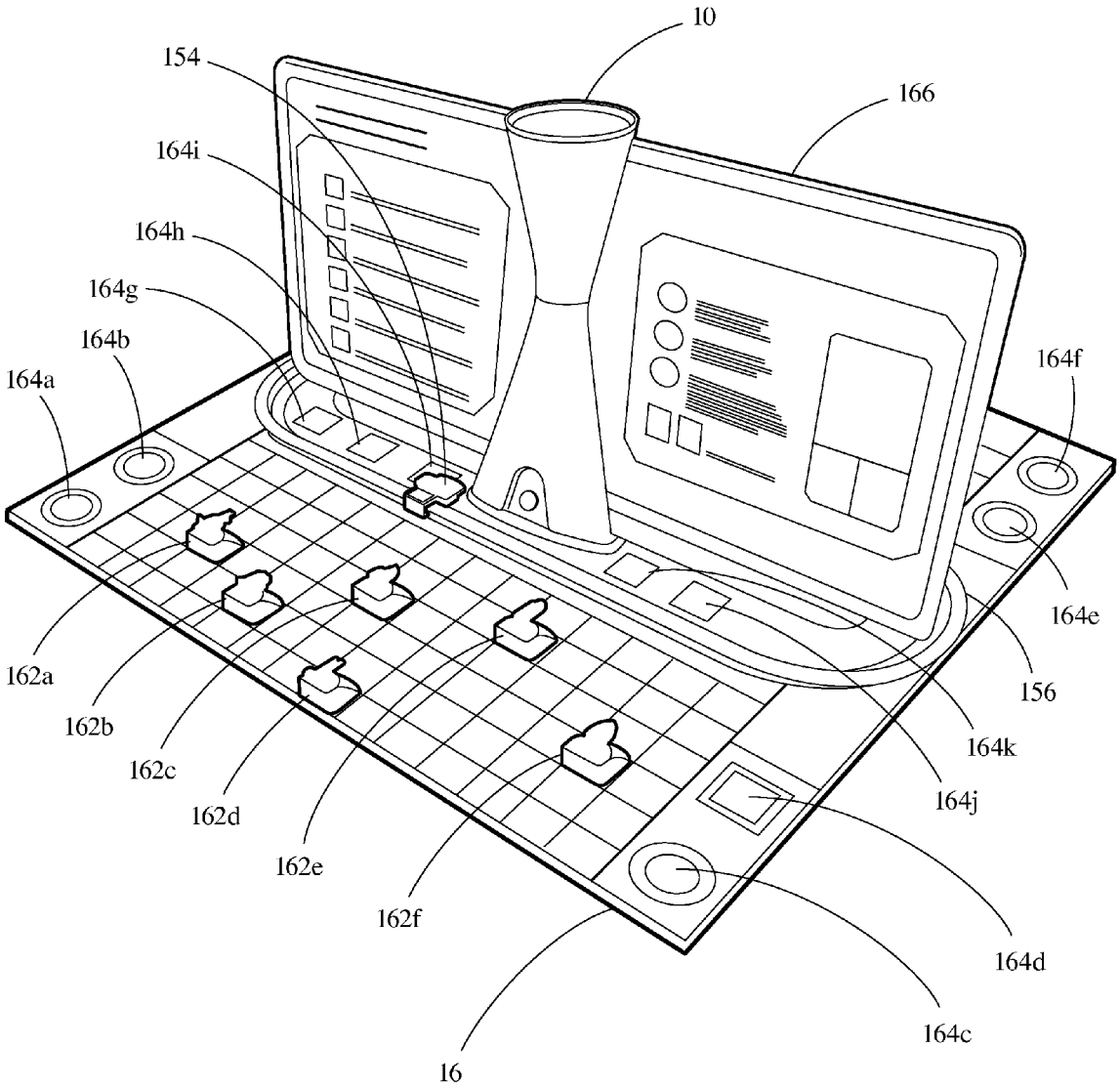
FIG. 14 shows a perspective view of a game tower that may be used to play a game of Battleship™.

As another example, FIG. 14 shows a perspective view of a game tower 10 that may be used to play a game of Battleship™. The game tower 10 is situated in the center of the game board 16 and mounted over center divider, which also acts as a Battleship™ instruction board 166. The Battleship™ instruction board 166 provides instructions for using the various Battleship™ retro-reflective regions 164*a*-164*k*. The Battleship™ game tokens 162*a*-162*f* are retro-reflective battleships or cannons and the game tower 10 keeps track of the position of the tokens as well as other game-related statistics. The shooter 154 is a retro-reflective spotter plane that moves along a track 156 in the center of the board. The spotter plane may be used to go into enemy territory and see how many of the enemy's ships are in a particular area of the game board 16. The game tower 10 tracks the position of all Battleship™ game tokens 162*a*-162*f*, tracks all damage, and tracks all sunken ships, among other game-related statistics. The Battleship™ retro-reflective regions 164*a*-164*k* provide controls to move Battleship™ game tokens 162*a*-162*f*, to control the shooter 154, to fire weapons, to use special powers, or to execute an air strike, among other possible functions. The game tower 10 guides game play from start to finish. The foregoing provides various exemplary functions to enhance the game of Battleship™.

The examples provided herein have been board games, these examples should not be limiting. Other embodiments, for example, which should also not be limiting, include various electronic learning aids (ELAs) as well as various input devices for computer control that are controlled by increases and decreases in sensed reflectivity. While the present inventions have been illustrated by a description of various embodiments and while these embodiments have been set forth in considerable detail, it is intended that the scope of the inventions be defined by the appended claims. It will be appreciated by those skilled in the art that modifications to the foregoing preferred embodiments may be made in various aspects. It is deemed that the spirit and scope of the inventions encompass such variations to be preferred embodiments as would be apparent to one of ordinary skill in the art and familiar with the teachings of the present application.

What is claimed is:

1. A game apparatus comprising:

a light source;

a housing disposed around the light source wherein the housing is transparent to a range of wavelengths from the light source and wherein the housing is composed of a low distortion scratch-resistant material;

a game board wherein the housing is removably mountable at the center of the game board;

a convex mirror disposed inside the housing such that light is reflected from the light source, off the convex mirror, through the housing, and onto the game board;

one or more retro-reflective elements placed on the game board that receive light emanated from the light source and reflected off of the convex mirror and reflect said light along the path from which the light was received;

a sensor disposed inside the housing that receives light reflected from the one or more retro-reflective elements, that senses increases and decreases in the intensity of the reflected light, and that signals changes in the intensity of the reflected light greater than or equal to a predefined level;

a data store for storing the locations of the reflective elements and other game-related data; and a processor responsive to signals from the sensor and the data in the data store.

2. The game apparatus recited in claim 1 wherein the game board has a hole in the center for removably mounting the housing and wherein the housing further comprises a flange to securely hold the housing in a fixed position relative to the game board.

3. The game apparatus recited in claim 1 wherein the housing is keyed to orient the housing to a notch in the game board so that the housing and the game board are consistently aligned.

4. The game apparatus recited in claim 1 wherein a cap is coupled to the housing to prevent light extraneous to the light source from reflecting off of the convex mirror.

5. The game apparatus recited in claim 4 wherein the convex mirror and the cap each have a hole centrally located that can be illuminated for alignment with the light source and the sensor during manufacture.

6. The game apparatus recited in claim 1 wherein the housing is tapered to minimize light not directly from said light source, such as reflections and light directly from somewhere other than said light source.

7. The game apparatus recited in claim 1 further comprising a shield coupled to the bottom of the light source and a tube surrounding the sides of the light source to mask unwanted light originating from the light source from reflecting off the convex mirror.

8. The game apparatus recited in claim 7 wherein the light source and the convex mirror share the same axis and are aligned to prevent an image of the light source from being detected by the sensor.

9. A game apparatus comprising:

a light source;

a housing disposed around the light source wherein the housing is transparent to a range of wavelengths from the light source and wherein the housing is composed of a low distortion scratch-resistant material;

a game board;

a convex mirror disposed inside the housing such that light is reflected from the light source, off the convex mirror, through the housing, and onto the game board;

one or more retro-reflective elements placed on the game board that receive light emanated from the light source and reflected off of the convex mirror and reflect said light along the path from which the light was received;

a sensor comprising a camera and a lens disposed inside the housing that receives light reflected from the one or more retro-reflective elements, that senses increases and decreases in the intensity of the reflected light, and that signals changes in the intensity of the reflected light greater than or equal to a predefined level wherein reflected light is focused into the camera using the lens;

a data store for storing the locations of the reflective elements and other game-related data; and a processor responsive to signals from the sensor and the data in the data store.

10. The game apparatus recited in claim 9 wherein the retro-reflective elements comprise at least one of a game token, a card and a region affixed to the game board.

11. The game apparatus recited in claim 9 wherein the data store and the processor are disposed inside the housing.

12. The game apparatus recited in claim 9 wherein the processor produces sensory output in response to signals from the sensor and data in the data store and wherein the sensory output provides guided game play.

13. The game apparatus recited in claim 9 wherein a cap is coupled to the housing to prevent light extraneous to the light source from reflecting off of the convex mirror.

14. A method for playing a game comprising:

emanating light from a light source;

surrounding the light source with a housing composed of a low distortion scratch-resistant material wherein the housing is transparent to a range of wavelengths from the light source;

providing a game board;

mounting a convex mirror inside the housing;

removably mounting the housing on the game board in a fixed position relative to the game board so that the housing and the game board are consistently aligned;

reflecting light from the light source off the convex mirror, through the housing, and onto the game board;

placing on the game board one or more retro-reflective elements, comprising at least one of a game token, a card, and a region affixed to the game board, that receive light emanated from the light source and reflected off of the convex mirror and reflect said light along the path from which the light was received;

providing a sensor disposed inside the housing that receives light reflected from the one or more retro-reflective elements, that senses increases and decreases in the intensity of the reflected light, and that signals changes in the intensity of the reflected light greater than or equal to a predefined level;

storing the locations of the reflective elements and other game-related data in a data store;

processing signals from the sensor and data in the data store using a processor; and producing sensory output using the processor to provide guided game play.

15. The method for playing a game recited in claim 14 further comprising aligning the light source and the convex mirror along a common axis so that light that is reflected from the light source to the convex mirror, off the one or more retro-reflective elements, coaxially back off the convex mirror, and to the sensor, is eclipsed by the light source to prevent unwanted glare while maintaining a panoramic area illuminated by the light source.

16. A game apparatus comprising:

a light source;

a housing disposed around the light source wherein the housing is transparent to a range of wavelengths from the light source;

a game board wherein the housing is removably mountable at the center of the game board;

a convex mirror disposed inside the housing such that light is reflected from the light source, off the convex mirror, through the housing, and onto the game board;

one or more retro-reflective elements placed on the game board that receive light emanated from the light source and reflected off of the convex mirror and reflect said light along the path from which the light was received;

a sensor comprising a camera and a lens disposed inside the housing that receives light reflected from the one or more retro-reflective elements, that senses increases and decreases in the intensity of the reflected light, and that signals changes in the intensity of the reflected light greater than or equal to a predefined level wherein reflected light is focused into the camera using the lens; and a processor in communication with said camera.

17. The game apparatus recited in claim 16 wherein the retro-reflective elements comprise at least one of a game token, a card and a region affixed to the game board.

18. The game apparatus recited in claim 16, comprising a data store for storing the locations of the reflective elements and other game-related data responsive to said processor and said camera.

19. The game apparatus recited in claim 18 wherein said processor produces sensory output in response to signals from said camera and data in the data store and wherein the sensory output provides guided game play.

20. The game apparatus recited in claim 18, further comprising a second data store for storing one or more discreet data modules wherein each discreet data module is a self-contained, comprehensive collection of all static data necessary for playing a single game.

* * * * *